US006196536B1

(12) United States Patent
Hintze

(10) Patent No.: US 6,196,536 B1
(45) Date of Patent: Mar. 6, 2001

(54) GRIP SET FOR AN ADJUSTABLE VICE

(75) Inventor: Paul H. Hintze, 2419 Pebble Valley Rd., Apt. 44, Waukesha, WI (US) 53188

(73) Assignee: Paul H. Hintze, Waudesha, WI (US)

( * ) Notice: Subject to any disclaimer, the term of this patent is extended or adjusted under 35 U.S.C. 154(b) by 0 days.

(21) Appl. No.: 09/520,779

(22) Filed: Mar. 8, 2000

Related U.S. Application Data

(60) Provisional application No. 60/123,456, filed on Mar. 9, 1999.

(51) Int. Cl.[7] ..... B25B 1/24

(52) U.S. Cl. ..... 269/282; 269/43; 269/283; 269/266

(58) Field of Search ..... 269/282, 283, 269/43, 266, 279, 262, 259

(56) References Cited

U.S. PATENT DOCUMENTS 1,249,207 * 12/1917 Ruff ..... 269/282
4,422,629 * 12/1983 Carlson ..... 269/282
4,445,678 * 5/1984 George ..... 269/88
4,706,949 * 11/1987 Dossey ..... 269/282
5,078,372 * 1/1992 Fizpatrick ..... 269/282

* cited by examiner

*Primary Examiner*—Stephen F. Gerrity
*Assistant Examiner*—Lee Wilson
(74) *Attorney, Agent, or Firm*—Reinhart, Boerner, Van Deuren, Norris & Rieselbach, s.c.

(57) ABSTRACT

An improved vise and an attachment for a conventional vise is disclosed that permits a user of the vise to machine all sides of a workpiece gripped between the jaws of the vise without having to remove the workpiece from the vise and incur operational downtime and expense. A plurality of grip blocks are removably attached either to the vise directly, or to a grip set attachment for the vise. The grip blocks may be selectively installed on either the vise or grip set at those areas which require holding power, and not installed from those areas along the gripped sides of the workpiece that the user desires to access. With a portion of the grip blocks selectively removed from the vise or grip set, the user can machine all sides of a gripped workpiece, including substantial portions of the sides of the workpiece gripped by the vise.

20 Claims, 5 Drawing Sheets

GRIP SET FOR AN ADJUSTABLE VICE

This application claims the benefit of U.S. Provisional Application No. 60-123,456, with a filing date of Mar. 9, 1999.

BACKGROUND OF THE INVENTION

1. Field of the Invention.

The present invention relates generally to a vise, and more particularly, to an improved grip set for an adjustable vise having a plurality of removable grip blocks, which allow a machinist, manufacturer, or hobbyist to efficiently and economically machine irregularly shaped parts by permitting access to all sides of a workpiece gripped between the jaws of the vise.

Vises are commonplace in both commercial manufacturing and residential settings, and are used to hold objects to be worked upon in a fixed position. Generally, a vise grips an article between a pair of cooperating jaws to allow a machinist, manufacturer, or hobbyist to cut, bore, or perform other mill work on the article's ungripped surfaces. For example, when a flat, square block is placed between the cooperating jaws of the vise, two sides of the block are gripped by the vise leaving the two remaining sides and the top exposed for machining and other mill work. The problem with and disadvantage of this conventional vise is that a user of the vise cannot machine or perform other mill work on the gripped sides of the workpiece without first repositioning it in the vise. This results in lost time and decreased efficiency, and, ultimately, represents increased expense to the manufacturer.

Often, an attachment is fixed to the face of each cooperating jaw, the attachment being used to either grip the workpiece held between the jaws, or to increase the maximum distance between the jaws of the vise to hold larger objects. Such attachments used to grip workpieces between the jaws are usually flat, but can also have a L-shaped ledge which allows a workpiece to rest upon a flat surface while being held between the opposing faces. An example of such an attachment is described in U.S. Pat. No. 4,706,949, to Dossey et al., which discloses the use of interchangeable attachments that may be attached to the jaws of a vise to hold irregularly shaped workpieces and perform different machining operations.

However, the Dossey et al. patent and other such attachments known in the art are troublesome to use because the attachments mounted on the cooperating jaws completely engage two entire sides of the gripped workpiece, thus preventing a machinist from accessing those sides. For instance, when the vise grips the generally flat, square workpiece previously described, only two sides and the top are accessible for machining or other mill work. Each of the attachments mounted on the cooperating jaws would cover each remaining two sides. Again, if such a workpiece required machining on all four sides, the machinist would need to release the article from the vise, rotate the article ninety degrees and then reinsert the article into the vise resulting in lost time and money.

Others have developed vise attachments that permit the clamping of workpieces of varying size. An example of such a product is described in U.S. Pat. No. 4,422,629, to Carlson, which discloses the addition of accessory members for attachment to the jaws of a vise. The accessory members allow a vise to grasp a workpiece the size of which otherwise exceeds the maximum distance between the jaws of the vise. Indeed, the Carlson patent and other similar attachments taught in the art do not overcome the disadvantages mentioned above, because single piece grip attachments that span the entire grip face prevent access to the gripped sides of a workpiece held by the vise.

To overcome the problems and disadvantages associated with the prior art, it is a primary objective of the present invention that it provide a vise for gripping a workpiece or the like that offers ready access to substantial portions of the gripped sides of the workpiece. It is a related objective that the gripping be facilitated by a plurality of gripping members, selective ones of which may be removed from the vise jaws, with the remaining gripping members holding the workpiece firmly in place.

It is a further objective of the present invention that it provide a mechanism for attaching the plurality of gripping members to a vise for gripping articles. The mechanism should allow access to the gripped sides of a workpiece and should be affixed to the vise jaws in a manner that allows for quick and efficient installation and removal.

It is yet a further objective of the present invention that the plurality of gripping members be easily installable and removable from either the vise jaws or the mechanism for attaching the plurality of members to the vise jaws. This objective should be accomplished in a manner that allows a user of the vise to access substantial portions of the gripped sides of the workpiece, without having to remove the workpiece from the vise.

Finally, it is also an objective of the improved grip set of the present invention that all of the aforesaid advantages and objectives be achieved without incurring any substantial relative disadvantage.

SUMMARY OF THE INVENTION

The disadvantages and limitations of the background art discussed above are overcome by the improved grip set for attachment to a vise which is taught by the present invention.

In part, the vise with attachments of the present invention provides an enhanced degree of working access to all sides of a clamped workpiece. As with conventional vises, the vise with attachments may have a pair of cooperating jaws, with each jaw having a grip face opposite the other jaw. The grip face of each jaw is urged towards the grip face of the other jaw by most any means, including a threaded rod or the like, as is conventional. The vise with attachments of the present invention diverges from conventional vises in that each jaw has a plurality of grip blocks to grip a workpiece that are removably attachable to at least one jaw of the vise. However, it is readily apparent to one of ordinary skill in the art that either one or both jaws may have such grip blocks attached thereto. Each of the grip blocks may be selectively removed to provide working access to an edge of the workpiece when held in the vise.

The grip blocks each have a recessed shoulder that extends laterally along the top surface thereof, and is used to grip the workpiece. Each of the grip blocks can also have a downwardly projecting extension which may fit in a mating relationship with a step extending upwardly from each of the jaws of the vise. The recessed shoulder has a flat resting surface parallel to the top surface of the grip block, and a gripping surface which is substantially normal to the resting surface, although the gripping surface may instead be at a variety of angles to the resting surface. When each of the grip blocks are removably installed on one of the jaws of the vise, the flat resting surface provides a level position to rest the workpiece upon while the jaws are urged towards one another so that the gripping surfaces may engage the workpiece and secure it firmly in place.

The grip blocks are removably attached to the vise jaws by a removable fastener such as bolt, which extends through a bolt hole in each of the grip blocks and into one of a plurality of threaded receiving holes tapped into each of the vise jaws. The grip block bolt hole may be counterbored so that upon inserting the bolt through the bolt hole and threading it into one of the receiving holes, the head of the bolt is recessed within the body of the grip block.

The extension projecting from the bottom surface of the grip block and the mating step on top of the vise jaws ensure that the bolt hole is quickly and properly aligned with the receiving hole. The mating step can be formed by cutting or forging a step into the top surface of each jaw. The step extends laterally across the grip face of each jaw and has a grip block stop and a grip block rest to fit the downwardly extending grip block extension in a mating relationship. When the grip block extension sits upon the grip block rest and abuts the grip block stop, the bolt hole and receiving hole align.

In part, the present invention further provides an attachment, otherwise known as a grip set, for attachment to a conventional vise having a pair of jaws movable towards one another. The grip set generally includes a master block with a plurality of removable grip blocks. The grip set may be removably attached to one of the jaws of a vise, or alternatively, may be removably attached to each of the jaws. Although the grip set is described herein as being removably attached to the vise jaw, one skilled in the art could derive the same benefits of the present invention disclosed herein by integrally manufacturing the master block into either one or both of the jaws of the vise.

The master block has a step forged or cut into the top surface thereof. The step has a grip block rest parallel to the top surface of the master block, and a grip block stop substantially normal to the grip block rest (although, as mentioned above, this angle may be varied as desired)

The master block may also be adapted for attachment to a grip face of a jaw of the vise. One method of adapting the master block is to bore one or more mounting holes through the body of the master block, although other methods of attachment will be readily discernable to one skilled in the art. The master block is then attached to one jaw of the vise by one or more mounting fasteners such as bolts, or other methods of attachment known by those skilled in the art. The holes can be counterbored to have a larger diameter than the bolt, so that the bolt head does not protrude beyond the surface of the master block body, where it could potentially damage a workpiece held within the vise. Within the hole, a shoulder is circumferentially located to engage the head of the bolt when the bolt is threaded into the vise jaws to attach the master block.

A plurality of removable grip blocks are removably attached to the master block in a manner similar to the technique used to attach the grip blocks to the jaws of a vise described above. Each of the grip blocks is removably attached to the master block by a removable fastener such as a locking bolt or the like to provide quick and efficient removal. Each grip block can then be selectively positioned to provide holding power where needed, or removed to provide access to portions of the gripped workpiece periphery where machining is required. Each of the grip blocks is of the construction described above, with a recessed shoulder and a downwardly projecting extension opposite the recessed shoulder.

The extension of each grip block fits in a mating relationship with the step of the master block to properly position the grip block upon the master block. The downwardly projecting extension abuts the upwardly projecting grip block stop when sitting upon the substantially flat grip block rest. When the step of the master block and the extension of the grip block are in such a mating relationship, the grip block sits upon the surface of the master block and is located over one of the threaded grip block locking holes tapped into the master block. As such, the grip block rest has substantially the same width as the extension, although this is not necessary. The step may also be utilized to grip a workpiece when grip blocks are not employed.

This invention overcomes the problems and disadvantages associated with the prior art by providing a vise for gripping a workpiece and the like that offers ready access to substantial portions of the gripped sides of the workpiece. The gripping is facilitated by a plurality of grip blocks, selective ones of which may be removed from the vise jaws, with the remaining grip blocks holding the workpiece firmly in place.

This invention also provides a mechanism for attaching the plurality of grip blocks to a vise for gripping a workpiece in the form of a grip set. The grip set allows access to the periphery of the workpiece, and allows the grip blocks to be selectively affixed to the vise jaws in a manner that allows quick and efficient installation and removal. The user of the grip set of the present invention has access to a substantial portion of the gripped sides of the workpiece by selectively removing and installing each of the grip blocks on the grip set, without having to remove the workpiece from the vise.

Finally, all of the aforesaid advantages and objectives are achieved without incurring any substantial relative disadvantage.

The above brief description sets forth rather broadly the more important features of the present invention so that the detailed description that follows may be better understood, and so that the present contributions to the art may be better appreciated. There are, of course, additional features of the invention that will be described hereinafter which will form the subject matter of the invention. In this respect, before explaining an embodiment of the invention in detail, it is to be understood that the invention is not limited in its application to the details of the construction and the arrangements set forth in the following description or illustrated in the drawings. The present invention is capable of other embodiments and of being practiced and carried out in various ways, as will be appreciated by those skilled in the art. Also, it is to be understood that the phraseology and terminology employed herein are for description and not limitation.

DESCRIPTION OF THE DRAWINGS

These and other advantages of the present invention are best understood with reference to the drawings, in which.

DETAILED DESCRIPTION OF THE PREFERRED EMBODIMENTS

Figure 1:
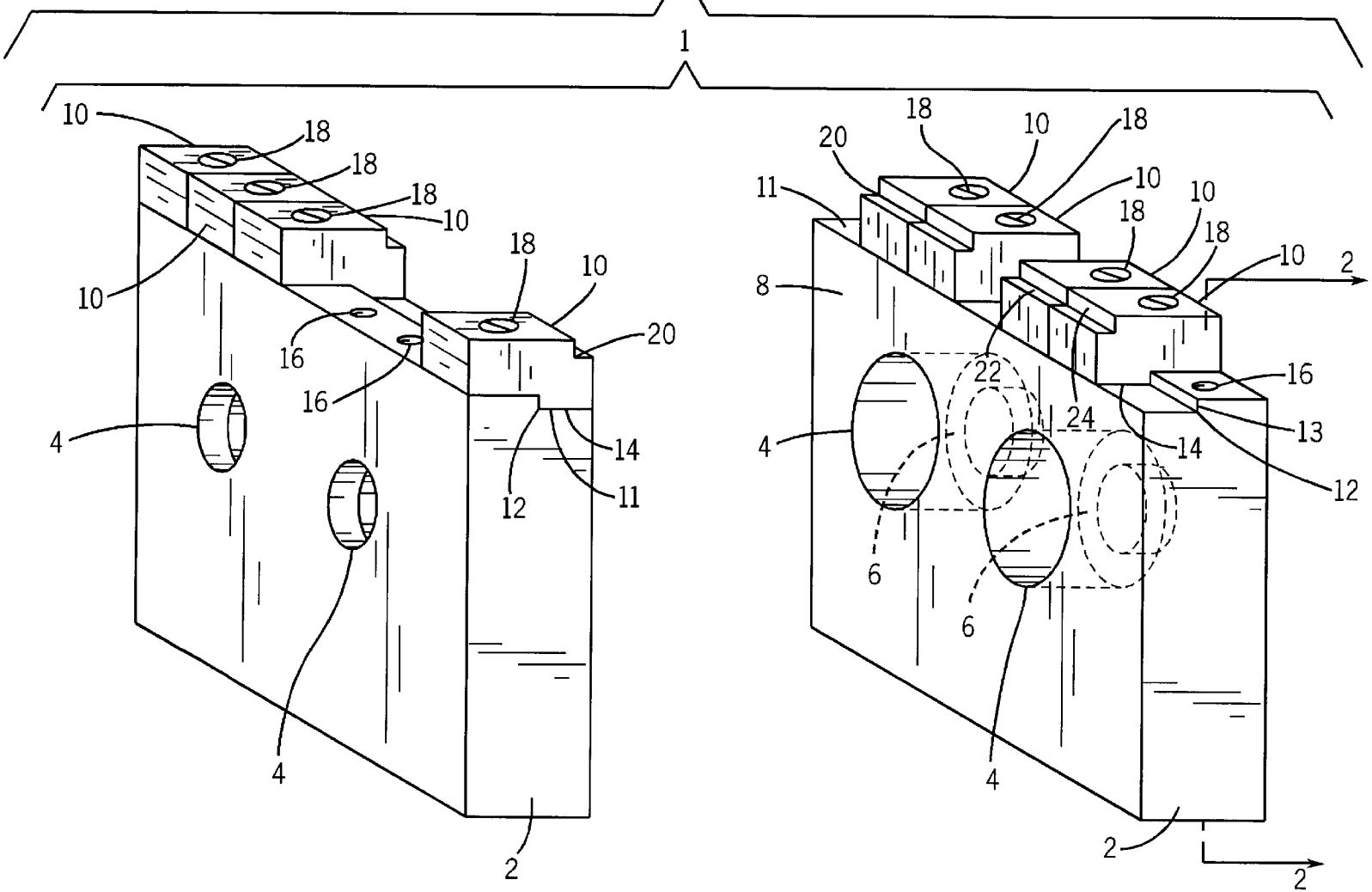
FIG. 1 is an isometric view of a pair of grip sets, which are constructed in accordance with the preferred embodiment of the present invention.

Turning now to the drawings, FIG. 1 shows a pair of grip sets, which are constructed in accordance with the preferred embodiment of the present invention, with each grip set 1 including a master block 2 and a plurality of grip blocks 10. When one or both of the grip sets 1 are attached to the jaws of a standard vise, the jaws can be urged towards one another to grip a workpiece.

In the preferred embodiment of the present invention, each of the master blocks 2 has at least a pair of mounting holes 4 for removably mounting each master block 2 to a vise jaw using a mounting fastener such as a bolt or other removable coupling device (the fastener and vise jaws not illustrated in FIG. 1). However, alternative embodiments may have more than two mounting holes bored into each master block. Each mounting hole 4 may be counterbored with a shoulder 6 located therein for abutting a bolt head, such that the bolt head will be recessed within the mounting hole 4 and will not extend beyond the master block inner wall surface 8.

Figure 2:
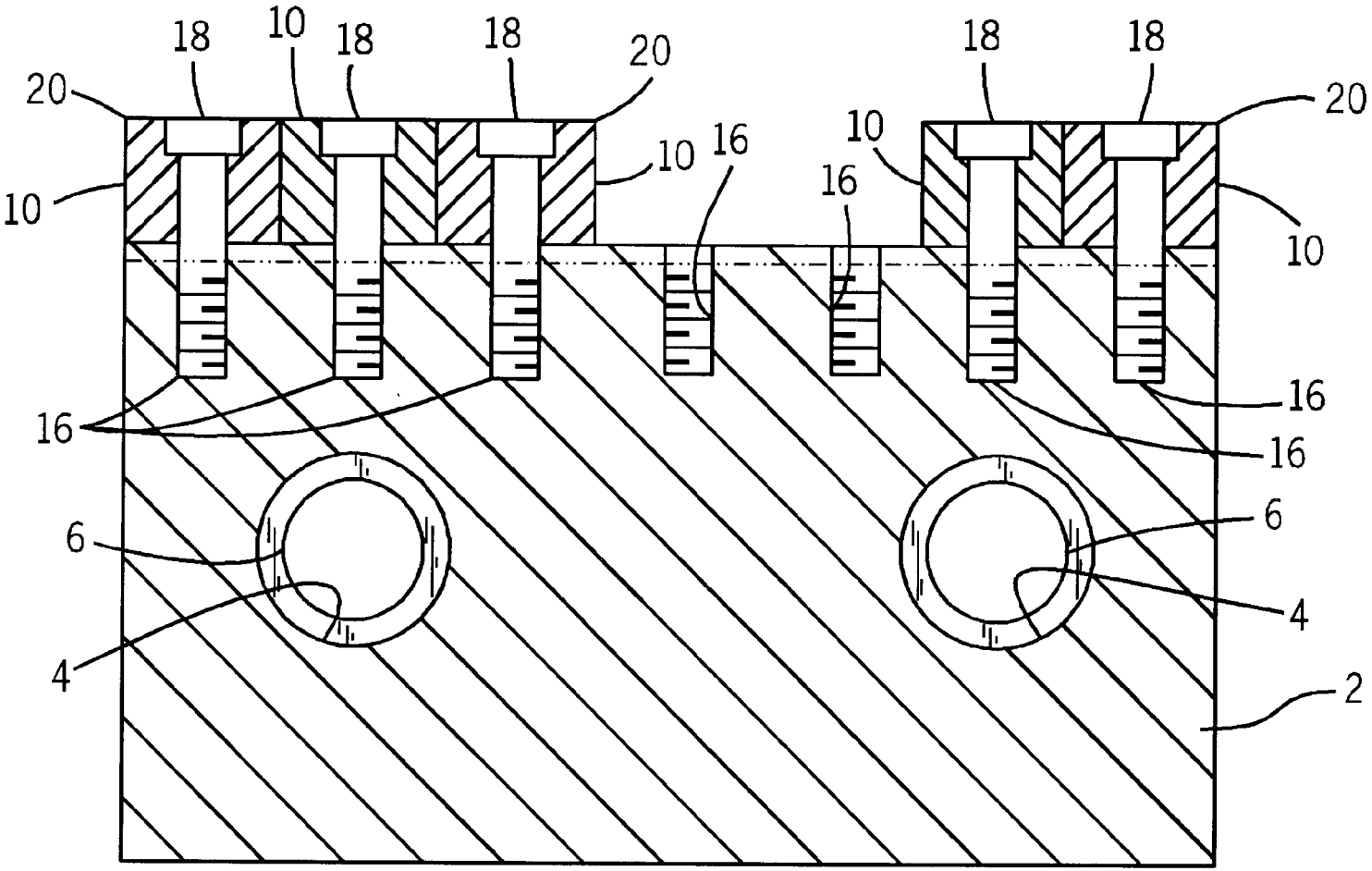
FIG. 2 is a cross-sectional plan view of the grip set illustrated in FIG. 1.
Figure 3:
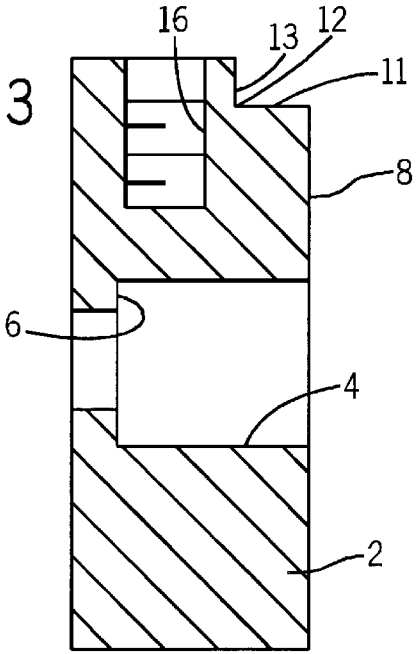
FIG. 3 is an cross-sectional side view of the master block of the preferred grip set illustrated in FIG. 1.
Figure 4:
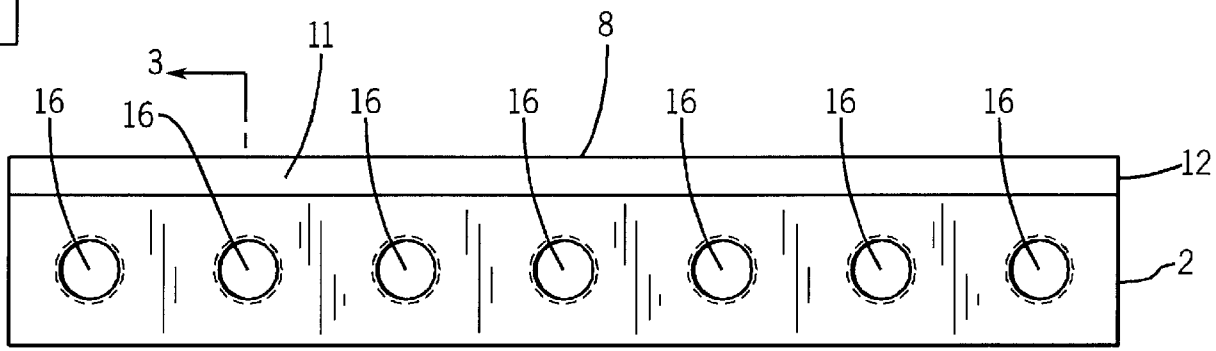
FIG. 4 is a top plan view of a master block of the preferred grip set illustrated in FIG. 1.

FIGS. 2, 3, and 4 illustrate the master block 2 in more detail. FIGS. 2 and 3 show a cross-sectional view of the preferred master block 2. FIG. 2 is a frontal view of the master block 2 with several grip blocks 10 being removably attached by corresponding grip block locking bolts 18, which are screwed into the threaded grip block locking holes 16. The shoulders 6 of each mounting hole 4 are coaxial with the holes 4. The shoulders 6 abut the heads of the locking bolts 18 (not shown in FIGS. 2,3, and 4) to prevent the heads of the bolts 18 from passing through the holes 4. FIG. 3 shows a cross-sectional side view of the master block 2, and illustrates more clearly the mounting hole 4 and shoulders 6.

FIG. 3 also shows a step 12, which can be machined, cast or forged into the master block 2 and extends laterally along the top surface of the master block 10 as shown in FIG. 1. The step 12 defines a substantially flat grip block rest 11 that is parallel to the top surface of the master block 2, and a grip block stop 13 that projects upwardly from the grip block rest 11 at a substantially normal angle. The step 12 can either be used to grip a workpiece when grip blocks 10 are not utilized, or to properly align the grip block 10 onto the master block 2 as described below.

FIG. 4 is a top plan view of the master block 2 of the preferred embodiment without any grip blocks 10 installed. This figure shows that the plurality of threaded locking holes 16 are linearly aligned on the top surface of the master block 2. The threaded bolt holes 16 receive the locking bolts 18 (shown in FIGS. 1 and 2) to hold each of the grip blocks 10 securely in place. Additionally, the grip block rest 11 of the step 12 can fit in a mating relationship with each of the grip blocks 10, as will be more fully discussed below.

Figure 5:
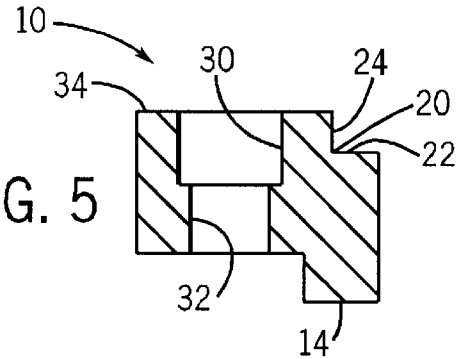
FIG. 5 is a cross-sectional side view of a grip block of the grip set illustrated in FIG. 1.
Figure 6:
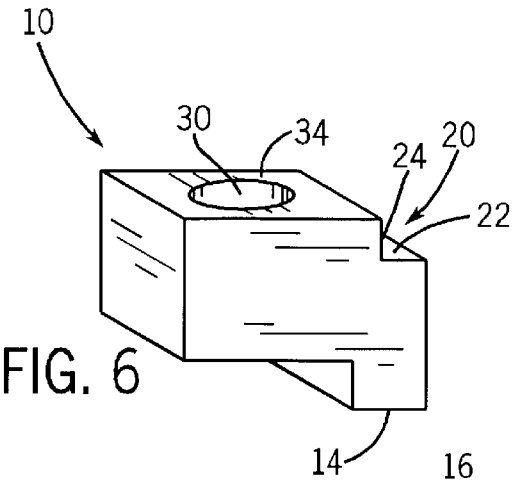
FIG. 6 is an isometric view of the grip block illustrated in FIG. 5.

Referring now to FIGS. 5 and 6, each of the preferred grip blocks 10 has a recessed shoulder 20 that extends laterally across the top surface 34 of each grip block 10, and a grip block extension 14 located on the surface opposite the top surface 34. The recessed shoulder 20 defines a flat resting surface 22 substantially parallel to the top surface 34 of the grip block 10, and a gripping surface 24 substantially normal to the resting surface 22. The flat resting surface 22 provides a level base to hold a workpiece (not illustrated in FIGS. 5 and 6) while the gripping surface 24 is urged towards the workpiece to secure it in a fixed position. The resting surface 22 can also be used to hold articles in a level position when the grip set 1 is attached to a vise installed horizontal with the ground to prevent undesired angled cuts, holes and other imperfect mill work. The width of the block extension 14 is preferably substantially the same width as the grip block rest 11 so that the grip block 10 neatly rests upon the master block 2 flush with the master block surface 8, although this is not necessary.

Figure 9:
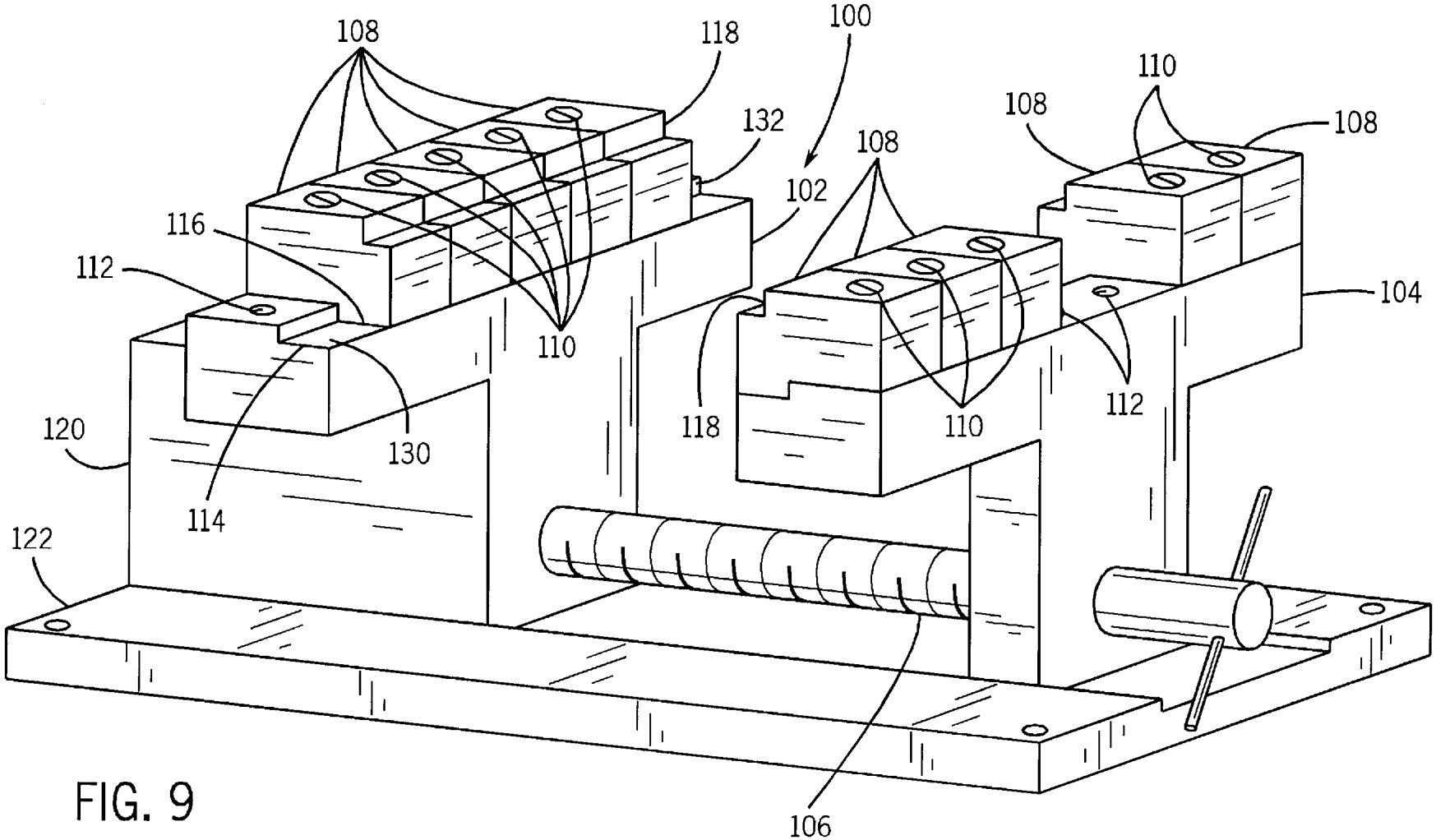
FIG. 9 is a perspective view of an adjustable vise with two jaws each having a plurality of grip blocks, which is constructed in accordance with one embodiment of the present invention.

As shown in FIGS. 1, 9, and 10, each of the grip blocks 10 may be removably mounted on each of the master blocks 2. In the preferred embodiment, each of the grip blocks 10 engages the master block 2 at the step 12. The downwardly projecting extension 14 of each grip block 10 matches the step 12 of the master block 2, so that the upwardly projecting grip block stop 13 abuts the extension 14, and the grip block rest 11 supports each grip block 10 at the extension 14. When the grip block extension 14 is positioned on the step 12 in this manner, the extension 14 fits in a mating relationship with the step 12, and correctly positions the grip blocks 10 onto the master block 2.

To removably attach each of the grip blocks 10 to the master block 2, grip block locking bolts 18 extend through a locking bolt hole 30 in each grip block 10, and into one of a plurality of threaded grip block locking holes 16 tapped into each master block 2. Each bolt hole 30 has a shoulder 32 for receiving the head of locking bolt 18 so that the bolt head does not protrude above the grip block top surface 34, or allow the locking bolt 18 to pass through the hole 30. The grip blocks 10 may be selectively positioned or removed on each of the master blocks 2. Grip blocks 10 are not installed at locations where machining such as cutting, boring, or other mill work known by those skilled in the art is required.

Figure 8:
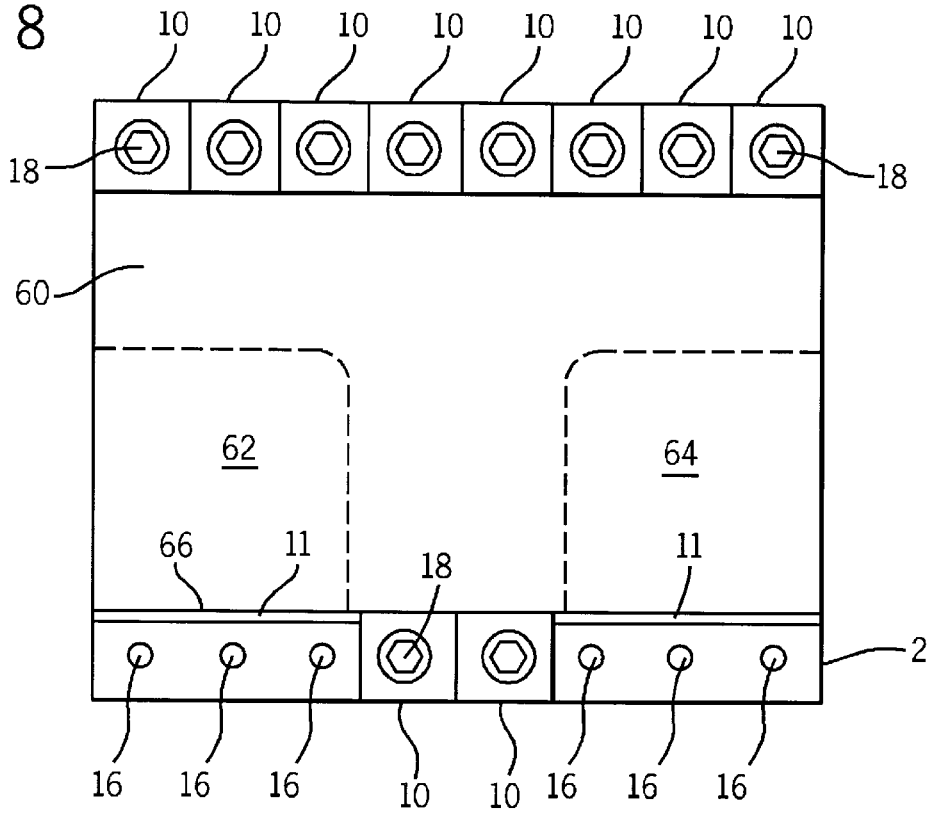
FIG. 8 is a plan view of a grip set holding an alternative workpiece, which is constructed in accordance with the present invention.
Figure 7:
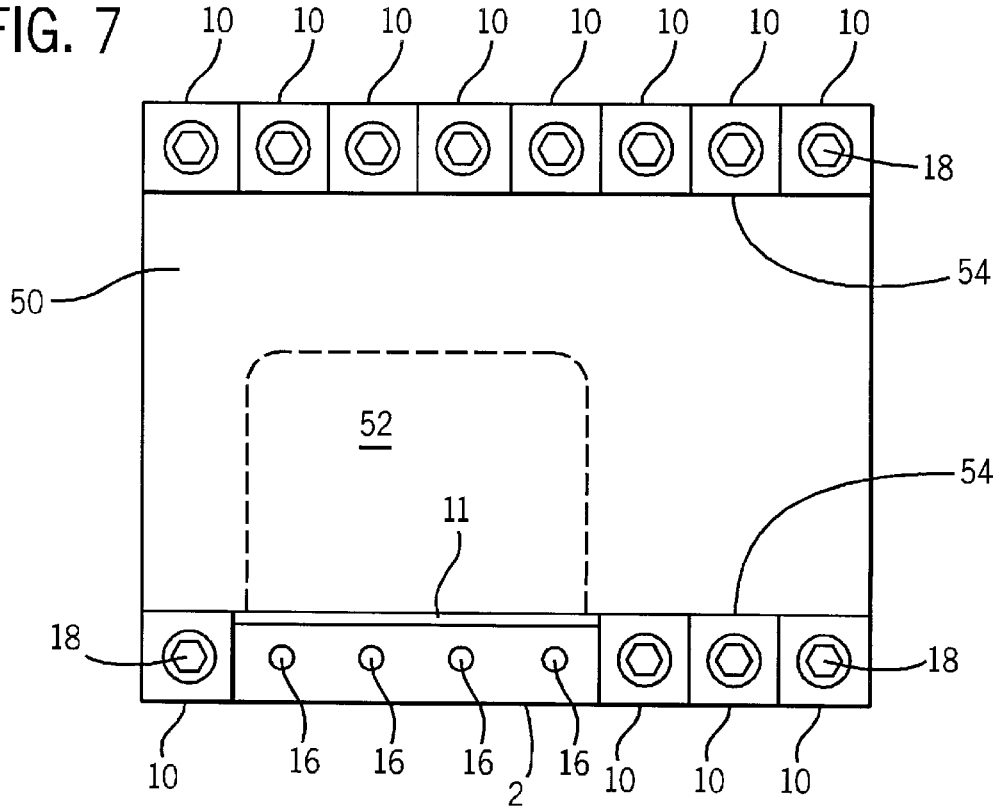
FIG. 7 is a plan view of a grip set holding a workpiece, which is constructed in accordance with the present invention.

To provide an example of how the grip set 1 of the present invention may be used, FIG. 7 illustrates a generally flat, square workpiece 50 that requires a notch 52 to be cut in the center of the workpiece 50 adjacent to a gripped edge 54. The grip blocks 10 are removed from the center portion of the master block 2 to provide working access to the gripped edge 54 of the workpiece 50. Another example is shown in FIG. 8, which shows a workpiece 60 that is held between the grip blocks 10 of each master block 2 and requires machining at two areas 62 and 64 adjacent the gripped edge 66. The grip blocks 10 are removed from the master block 2 where access to the workpiece 60 is desired, and grip blocks 10 remain where access is not needed to provide holding power.

FIG. 9 shows a perspective view of an alternative embodiment of a vise 100, which is constructed in accordance with the present invention. The vise 100 has a fixed jaw 102 and a cooperating moving jaw 104, with a threaded screw member 106 for urging the jaws 102 and 104 towards one another. The vise 100 also has a body 120 with a base 122, which may be used to mount the vise 100 on a table, bench, or the like. A plurality of grip blocks 108 are removably mounted on each of the jaws 102 and 104 by fasteners 110 such as recessed mounting bolts, which extend through the grip blocks 108 and into threaded receiving holes 112 in each of the jaws 102 and 104.

Each of the grip blocks 108 are of the same type as previously disclosed herein, and have a recessed shoulder 118 for holding a workpiece in a secure and fixed position, and a downwardly projecting extension 116. The jaws 102 and 104 have a step 114 that extends laterally across the top surface of each jaw 102 and 104 for receiving a grip block extension 116 of each grip block 108. The step 114 has a flat grip block rest 130, and a grip block stop 132 that is substantially normal to the grip block rest 130. The grip block extension 116 fits in a mating relationship with the step 114 so that the extension sits upon the grip block rest 130 and abuts the grip block stop 132. By selectively removing or installing each of the grip blocks 118, the workpiece may be held in manner that allows a user of the vise to access a gripped edge of the workpiece.

The advantages of the disclosed invention are thus attained in an economical, practical and facile manner. While preferred embodiments and example configurations have been shown and described, it is to be understood that various further modifications and additional configurations are apparent to those skilled in the art. It is intended that the specific embodiments and configurations herein disclosed are illustrative of the preferred and best modes for practicing the invention, and should not be interpreted as limitations on the scope of the invention as defined by the appended claims.

What is claimed is:

1. A vise having a pair of cooperating jaws, each of said jaws comprising:

(a) a grip face having a top surface;

(b) a plurality of grip blocks linearly aligned along said top surface of said grip face, each of said grip blocks having a recessed shoulder located in a top side thereof and a downwardly projecting extension projecting from a bottom side thereof and located opposite said recessed shoulder; and (c) a plurality of removable fasteners each of which removably mounts one of said grip blocks to one of said jaws.

2. The vise of claim 1, wherein said grip face comprises a step extending laterally along said top surface of said grip face, said extension of each said grip block fitting in a mating relationship with said step of said grip face.

3. The vise of claim 2, wherein said step defines a grip block rest and a grip block stop substantially normal to said grip block rest.

4. The vise of claim 1, wherein said recessed shoulder of each of said grip blocks defines a resting surface and a gripping surface substantially normal to said resting surface.

5. The vise of claim 1, wherein said plurality of removable fasteners each comprise a bolt.

6. An apparatus for attachment to a vise having a pair of jaws, said apparatus comprising a grip set for attachment to each of said jaws, each of said grip sets comprising:

(a) a master block having a top surface; and (b) a plurality of grip blocks removably coupled to said master block, each of said grip blocks linearly aligned on said top surface of said master block.

7. The apparatus of claim 6, which further comprises a plurality of removable fasteners each of which removably mounts one of said grip blocks to said master block.

8. The apparatus of claim 7, wherein said plurality of removable fasteners each comprise a bolt.

9. The apparatus of claim 6, wherein each of said grip blocks further comprises a recessed shoulder extending laterally across each said grip block, said recessed shoulder having a resting surface and a gripping surface substantially normal to said resting surface.

10. The apparatus of claim 6, wherein eight grip blocks are removably attached to said master block.

11. The apparatus of claim 6, wherein said master block has a step extending laterally across said top surface of said master block, and each said grip block has an extension fitting in a mating relationship with said step to properly position each said grip block on said master block.

12. The apparatus of claim 6, which further comprises a plurality of mounting fasteners each of which removably attaches said master block to one of said jaws.

13. The apparatus of claim 12, wherein said plurality of mounting fasteners each comprise a bolt.

14. The apparatus of claim 12, wherein said master block surrounds at least two apertures that each accommodates one of said mounting fasteners, each of said apertures having a shoulder coaxially located therein.

15. A grip set for removable attachment to a vise having at least one jaw with a grip face, said grip set comprising:

(a) a master block having a top surface and step extending laterally across said top surface;

(b) a plurality of grip blocks, each of said grip blocks having a downwardly projecting extension for mating engagement with said step, and a recessed shoulder located opposite said extension on said grip block;

(c) a plurality of removable fasteners for removably mounting each of said grip blocks to said master block; and (d) a plurality of mounting bolts that removably attaches said master block to said grip face of at least one said pair of jaws.

16. The grip set of claim 15, wherein said master block surrounds at least two mounting holes which each accommodates one of said mounting bolts.

17. The grip set of claim 16, wherein each of said mounting holes has a diameter larger than the diameter of each of said mounting bolts, and a shoulder coaxially located within each of said mounting holes to abut said mounting bolts when one of said mounting bolts are located within one of said mounting holes.

18. The grip set of claim 15, wherein said step of said master block has a grip block rest substantially parallel to said top surface of said master block, and a grip block stop substantially normal to said grip block rest, said grip block rest having a width substantially equal to said extension of each said grip block to fit said extension in a mating relationship.

19. The grip set of claim 15, wherein said recessed shoulder of each said grip block has a resting surface and a gripping surface substantially normal to said resting surface.

20. The grip set of claim 15, wherein said plurality of removable fasteners each comprise a bolt.

* * * * *

UNITED STATES PATENT AND TRADEMARK OFFICE

CERTIFICATE OF CORRECTION

PATENT NO. : 6,196,536 B1
DATED : March 6, 2001
INVENTOR(S) : Paul H. Hintze

It is certified that error appears in the above-identified patent and that said Letters Patent is hereby corrected as shown below:

Title page,
Column 1,
Line 54, "VICE" should be -- VISE --;
Line 73, "Waudesha" should be -- Waukesha --;

Column 1,
Line 1, "VICE" should be -- VISE --.

Signed and Sealed this

Twentieth Day of November, 2001

*Attest:*

Nicholas P. Godici

*Attesting Officer*

NICHOLAS P. GODICI
*Acting Director of the United States Patent and Trademark Office*